United States Patent [19]

Gustavsson et al.

[11] 4,370,915

[45] Feb. 1, 1983

[54] TOOTH FOR RAMMING UNIT

[75] Inventors: Olle Gustavsson; Göran Sundmar, both of Karlskoga, Sweden

[73] Assignee: Aktiebolaget Bofors, Bofors, Sweden

[21] Appl. No.: 217,636

[22] Filed: Dec. 18, 1980

[30] Foreign Application Priority Data

Dec. 18, 1979 [SE] Sweden ..... 7910438

[51] Int. Cl.[3] ..... F41F 9/00

[52] U.S. Cl. ..... 89/47

[58] Field of Search ..... 89/33 BC, 45, 47

[56] References Cited

U.S. PATENT DOCUMENTS 4,157,678 6/1979 Hultgren et al. ..... 89/47

*Primary Examiner*—Stephen C. Bentley

*Attorney, Agent, or Firm*—Pollock, Vande Sande & Priddy

[57] ABSTRACT

A ramming unit comprises a tooth (5) which is placed at the front parts of the unit. The tooth is arranged so that it can be raised and lowered, and in its raised position the rear side (5*a*) of the tooth coacts with a shell (2) or the like when this is rammed in a firearm by means of the ramming unit. In its lowered position the tooth permits the passage of a bag charge (4) or the like which is to be placed behind the shell in the bore of the barrel. The tooth and the other parts are made with force relieving means which transfer substantial parts of the forces arising on the tooth in connection with the ramming direct to said other parts of the ramming unit, and not via the supporting means of the tooth.

9 Claims, 3 Drawing Figures

TOOTH FOR RAMMING UNIT

TECHNICAL FIELD

The present invention relates to a tooth belonging to a ramming unit which is supported to be raised and lowered so that in its raised position it will permit coaction via its rear edge with a first ammunition unit, and in its lowered position permit passage of a second ammunition unit via its inner surface, it then being possible for a first section arranged on the tooth to be in contact with a corresponding section arranged on the other part of the ramming unit for distinctly determining the raised position.

BACKGROUND ART

In a loading system for an artillery piece, e.g. a field howitzer, it is known to achieve a more rapid loading procedure for separate loading ammunition with the aid of a loading tray for the shell or the like which can be swung in from the side. A rammer head, which can likewise be swung in from the side, is arranged to receive a charge or bag charge, and can also be swung in behind the projectile when the loading tray has assumed its swung-in position and is coaxially displaceable in relation to the loading tray, to enable the ramming of the projectile in the bore of the barrel by means of the rammer head.

The known ramming unit is then arranged so that in front of its section supporting the charge or bag charge it supports a tooth which can be raised and lowered, which actually constitutes a continuation of the supporting section. The tooth is arranged to function so that in its raised position, via its rear side, it will achieve the displacement of the shell over the loading tray at the movement of the ramming unit in relation to the loading tray, and in its lowered position it will permit the bag charge placed in the ramming unit to pass on its inside behind the shell in the bore of the barrel.

TECHNICAL PROBLEM

Owing to the fact that it must be possible for the comparatively heavy projectile to be accelerated rapidly even at very high elevations (e.g. 60° and more) of the firearm, the stresses arising in the ramming unit and its various parts in conjunction with the ramming procedure will be very high, which has involved lowered ramming speeds and/or comparatively frequent service intervals.

SUMMARY OF THE INVENTION

The main purpose of the present invention is to solve the aforesaid problem. The feature for the new tooth in accordance with the invention is that said first section on the tooth supports a first force relieving means which in the raised position of the tooth is engaged with a corresponding second means on said second section on the other part of the ramming unit so that the stresses which arise in the tooth during coaction with the first ammunition unit to a major extent is transferred directly to the other part of the ramming unit and not via said support.

In further developments of the concept of the invention it is proposed that all of the stresses be transferred direct to the ramming unit. Further indications are provided for setting the tooth at an angle in relation to the other parts of the ramming unit so that only one point of application will be obtained on the rear surface of the shell or the like, and so that the point of application will be located at the lower points of the rear surface. The further developments also take into consideration the details of the design of the force relieving means and the design of the tooth in order to achieve a guiding of the bag charge into its position in the bore of the barrel.

Through the invention efficient protection will be obtained for one of the most vital parts of the ramming unit, viz. the support for the tooth which can be raised and lowered. By the proposed angular positions of the tooth in its raised position proposed in connection with the further developments the support will be protected still more effectively. The point of application will be low down, and not out at the free end of the tooth.

In connection with the further development it is also proposed that the tooth should be made with a friction surface or a welt for the bag charge. The friction surface or welt is arranged so that after the ramming unit has inserted the bag charge in the bore of the barrel behind the projectile it will pull the bag charge rearwards during its movement towards the rear, during which the bag charge will enter into coaction with a stripper arranged in the breech ring and will be drawn off from the unit and its lowered tooth. In this way the bag charge will come into its most advantageous position up against the inner surface of the screw breech block when closed, after the ramming unit has been out of the way.

BRIEF DESCRIPTION OF FIGURES

An embodiment proposed at present of a tooth which has the characteristics significant for the invention will be described in more detail in the following, with reference to the accompanying drawings, in which FIG. 1 in a vertical view and partly in cross section shows parts of the ramming unit with its tooth in the raised position and in connection with a loading tray partly shown, in which a shell, partly shown, is applied, and parts of a bag charge in the ramming unit are also shown, FIGS. 2*a*–2*d* in various views and sections show the details of the design of the tooth, and FIGS. 3*a*–3*d* in various views and sections show the other parts of the ramming unit with which the tooth is intended to coact, which other parts are intended to be fastened to and integrated in a rammer head.

BEST MODE OF CARRYING OUT THE INVENTION

As the loading system with which the present invention can be used is previously well known, only the parts of the system which the present invention directly concerns will be described here in detail.

Figure 1:
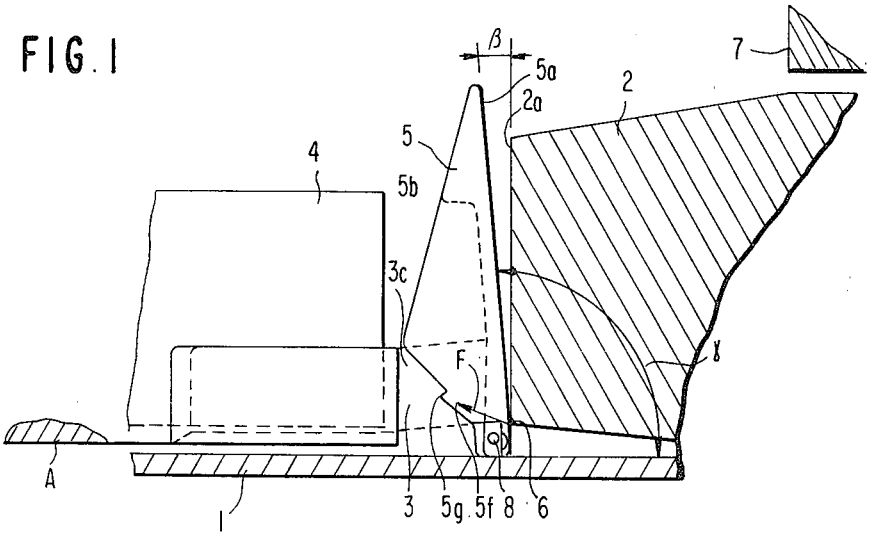

In FIG. 1, the numeral 1 shows part of a loading tray which is located at the rear parts of a firearm. The loading tray can be swung to the side in order to provide for the application of a first ammunition unit in the form of a shell 2, or the like, in a swung-out position, and also to enable a shell thus applied to be swung into the extension of the axis of the bore of a barrel. The reason for swinging aside is that the loading tray shall not participate in the recoil movements of the firearm.

The numeral 3 shows parts of a ramming unit which can also be swung into the extension from a swung away position, in which a second ammunition unit, e.g. a bag charge 4, is applied. At its swinging-in, the ramming unit assumes a position behind the shell, and the ramming unit is coaxially displaceable in relation to the loading tray. At its movement in relation to the loading tray, the unit goes into coaction with the rear surface of the shell, and inserts the shell in the bore of the barrel with a comparatively high ramming speed, 4–6 m/sec. The coaction takes place via a tooth 5 on the unit, which is supported in such a way that it can be raised and lowered in the other parts of the ramming unit at the front section. In principle, the parts 3 constitute a nose section of an elongate rammer head, which is known in itself, and which is indicated by A, in which the nose section can be fastened by means of rivets, welding, etc.

At the above-mentioned coaction, the tooth assumes the raised position shown in FIG. 1, and the coaction takes place via the rear side 5*a* of the tooth.

When the unit has moved the shell into its position in the bore of the barrel, the unit is retracted, and the tooth, in response to the movement which results because of its suspension in the other parts of the unit, tends to fall forwards towards its lower position. The tooth is intended to brake the bag charge when this slides forwards in the ramming unit, to be stopped against the rear surface of the shell or against the tooth if this is not entirely lowered.

The length of the bag charge can be varied, and several bag charges can also be placed in a series after each other on the ramming unit. As it is important to ensure that the rear part of the bag charge always will be close to the inner surface of a screw or wedge breech block belonging to the firearm, it is essential that the bag charge can be retracted to the position of the surface in case the length of the bag charge or bag charges is less than the distance from the rear surface to the rear surface 2*a* of the shell in the bore of the barrel. For this, the tooth is made with a friction welt 5*b*.

Like the other part of the ramming unit, the tooth has a trough form. Also the rear side 5*a* of the tooth has a trough form, but for the rest is straight. The raised position shown in FIG. 1 is then such that the rear side 5*a* is inclined somewhat rearwards so that an angle $\alpha$ between the rear side and inner surface of the loading tray somewhat exceeds 90°. The angle can then be between 92° and 100°, particularly between 93° and 98°. In the embodiment shown, the angle is approx. 95°, which gives an angle of application of $\beta$ between the rear side 5*a* and the rear surface 2*a* of the shell of approx. 5°.

This gives the advantages of having a low point of application 6 for the unit against the rear surface 2*a*. The low point of application is combined with a rearing guard 7 arranged in the loading system and extending in the longitudinal direction of the shell. The rearing guard for the shell makes it possible for the angle of application and therewith the low point of application to be retained during the entire ramming procedure.

The tooth is supported on a journal in the other parts of the ramming unit, and in FIG. 1 the supporting journal is indicated by 8.

Figure 2A:
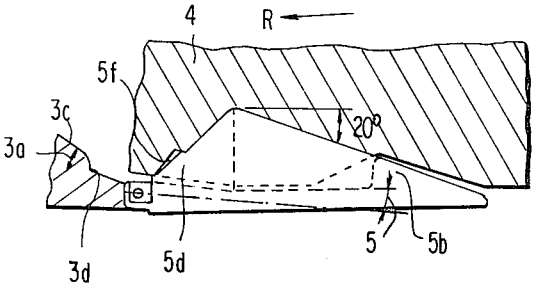
Figure 2D:
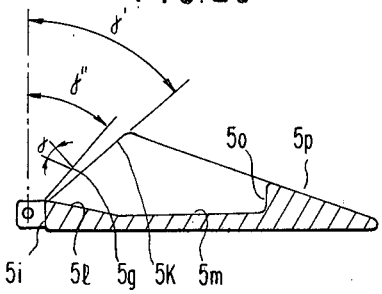
Figure 2B:
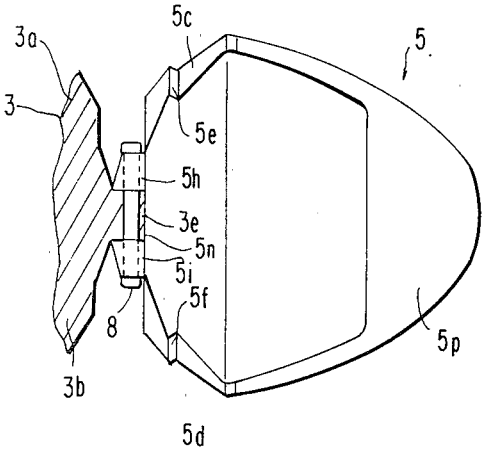
Figure 2C:
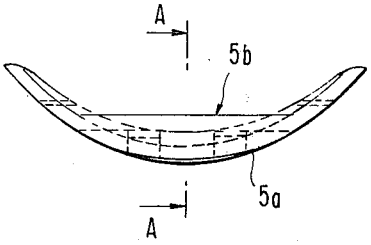
Figure 3A:
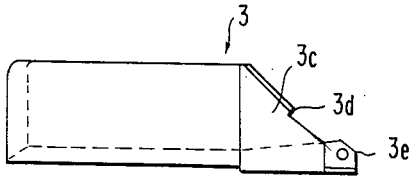
Figure 3D:
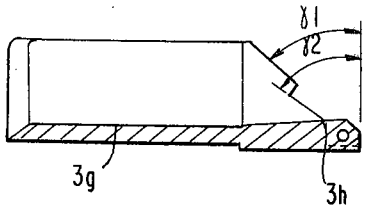
Figure 3B:
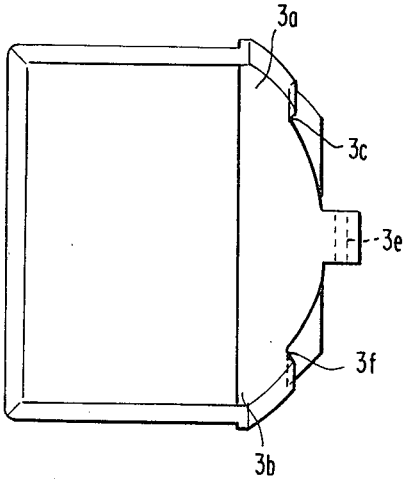
Figure 3C:
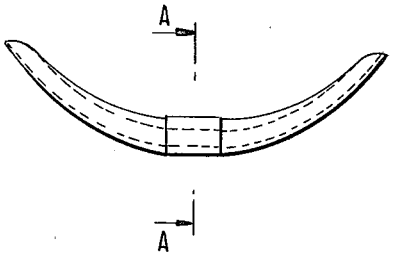

FIGS. 2*a* and 2*b* intend to show, inter alia, the lowered position of the tooth, and in FIG. 2*a* the retracting function for the bag charge 4 is shown. The bag charge, which is comparatively soft, will adapt itself to the inner surface of the tooth, and the welt 5*b* will then dig into the bag charge and tend to retract the bag charge at the rearward movement of the unit and the tooth.

At its rear upper edges, the trough shaped tooth is made with sections 5*c* and 5*d*. At the sections and rear upper edges force relieving means in the form of lugs 5*e* and 5*f*, respectively, are arranged. The sections 5*c* and 5*d* can coact with corresponding sections 3*a* and 3*b*, respectively, on the other part of the ramming unit, and the corresponding sections have corresponding force relieving lugs, one of which is shown by 3*c* in FIG. 2*a*. In the raised position according to FIG. 1, the force relieving lugs on the respective sections are in engagement with each other. The relieving surface 5*g* on the force relieving lug 5*f* and 5*e*, respectively, which is in engagement with a corresponding surface 3*d* on the lug 3*c* is then turned away from the supporting journal 8, which gives two advantages, in that it does not have any edge or any corner which can hook into the cloth of the bag charge, and also that it fields the angle $\gamma$ so that it serves as a guide and relief when the tooth goes up to the surface 3*d* of the force relieving lug. The relieving surfaces are also set obliquely in relation to the main direction of the upper edge in question, whereby optimal relieving to the other part of the ramming unit is obtained for the forces acting on the tooth in connection with the ramming, which forces have a main direction in accordance with the arrow F in FIG. 1.

By the force relieving lug having its relieving surfaces 3*d* and 5*g* in contact with each other in the raised position, the ramming forces will be transferred direct to the other parts of the ramming unit, and will thus not cause a load on the supporting journal 8, which results in a long life for the journal 8.

The tooth has two supporting parts 5*h* and 5*i* which extend over a supporting part 3*e* on the other part of the ramming unit, which supporting parts in a known way have supporting holes for the supporting journal 8. The lowered position of the tooth is determined by coaction with a front edge 3*e* and a surface 5*n* on the rear parts of the tooth. The tooth can thus form an extension of the ramming unit even when the tooth has no support under it.

As shown in FIG. 2*d*, the respective force relieving surface 5*g* is inclined relative to the normal towards the upper edge surface 5*k*. The inclination is 10°–20°, particularly approx. 15°. The inner surface of the trough shaped tooth can be considered to consist of a first part inner surface 51, which is inclined downwards viewed from the support by approx. 10°, a straight second part inner surface 5*m*, and a transversal or vertical third part inner surface 5*o*, which goes over into a fourth part inner surface 5*p* which from the transversal surface is inclined obliquely downwards to the point of the tooth. Through the last-mentioned two surfaces, said welt 5*b* is formed. Counted from the vertical line through the support, the upper edge surface 5*k* is inclined at an angle $\gamma'$=approx. 50° while the upper surface forming the lug 5*f* has an angle $\gamma''$ of approx. 40°.

The inclination of the plane 51, and also the inclination of the plane 3*e* have been incorporated in order to make it possible to utilize a comparatively heavy pin 8. This has been done in order to keep the thickness of the material small, to make it possible to insert even the bag charges with the largest diameters together with the rammer tooth including a bore diameter 158.5 mm, for which the maximum bag charge diameter is 155.5 mm. Since the support comprises only a small portion of the circumference, it does not have a negative effect if the thickness of the material is increased in order to obtain a stronger pin. The bag charge is only squeezed in slightly at the point in question along its circumference.

Viewed in the horizontal plane according to FIG. 2*b*, the tooth is moreover narrowed towards its point, which contributes towards the squeezing effect on the bag charge in question which is to be retracted in the bore of the barrel. The protruding side edges then end at a distance from the point of the tooth which is $\frac{1}{4}$–$\frac{1}{3}$ of the length of the tooth. The fourth part inner surface of the tooth will thereby be developed, and the entire point in question of the tooth is solid, which facilitates the lowering of the tooth to the lowered position.

When the ramming unit has been moved out of the barrel after the ramming, in connection with the swinging away to the side position, a coaction takes place between the tooth and a fixed cleat or the like in the loading system which forces the tooth up into its raised position, etc.

The other parts in question on the ramming unit are shown in detail in FIGS. 3*a*–3*d*. The parts have a trough shaped inner surface 3*g* which for the rest is straight, except for the inner part which is inclined from the support 3*e* by approx. 5°. The angles which correspond to the angles $\gamma'$ and $\gamma''$ in FIGS. 2*a*–2*d* have here been designated $\gamma_1$ and $\gamma_2$. If $\gamma'=50°$ is $\gamma_1=45°$ and if $\gamma''=40°$ then $\gamma_2=55°$. The inclination of the relieving surface mentioned above, here designated 3*h*, is the same as the inclination of the surface 5*g*. It should be mentioned that the arrangement of the relieving lugs on the respective side is identical in the present case.

The invention is not limited to the embodiment shown above as an example, but can be subject to modifications within the scope of the following claims and the concept of the invention.

INDUSTRIAL APPLICABILITY

The structural unit proposed according to the invention comprises a few and simple parts, which are easy to manufacture and assemble at a factory. The parts can then easily be integrated in the loading system at a factory, or out in the field.

We claim:

1. In a ramming unit for an artillery piece, an improved mechanism for displacing a shell from a loading tray and permitting a charge to be loaded behind said shell comprising:

a journal for supporting a tooth member to a table of said ramming unit;

a tooth member formed as a trough carrying a welt, connected to said journal, said tooth member being swingable from a vertical position for engaging said shell to a horizontal position for engaging said charge, said tooth member having a forward surface facing said shell rear surface during its vertical position which contacts said shell at a lower portion thereof, and forms an acute angle with said shell, said tooth member having a second surface forming an acute angle with said forward surface at said journal and extending rearward thereof, said second surface including first and second force relieving surfaces;

third and fourth relieving surfaces on a movable ram unit for engaging said second surface first and second force relieving surfaces, whereby forward motion of said movable ram applies a force to said tooth member for forcing said shell into said artillery piece; and said tooth member in said horizontal position permitting said charge to be received in said trough and engaged by a welt in said trough, whereby said charge is withdrawn in response to movement by said movable ram to a preferred location for firing.

2. The ramming unit of claim 1 wherein said forward surface makes an acute angle with said shell rear surface of substantially 5°.

3. The ramming unit of claim 1 wherein said forward surface acute angle is between 2° and 10°.

4. The ramming unit of claim 1 wherein said forward surface acute angle is between 3° and 8°.

5. The ramming unit of claim 1 wherein said trough extends from an open end at said journal to a second end having a perpendicular step.

6. The ramming unit of claim 1 wherein said first and second force relieving surfaces make an oblique angle with respect to said forward surface.

7. A tooth according to claim 1, characterized in that the welt is formed by increased material thickness at the free end of the tooth.

8. In an artillery piece having a ramming unit for inserting ammunition components in a bore of a barrel of said artillery piece, an improved tongue mechanism comprising:

a supporting journal connected to a loading tray table of said artillery unit;

a tongue supported to said journal for rotation, said tongue having a first shell engaging surface which in a horizontal position of said tongue rests on said table and in a vertical position rests against said shell, said tongue including opposite said shell engaging surface first and second contiguous force relieving surfaces at an oblique angle with said shell engaging surface;

a ramming unit supported for horizontal motion on said table on a side of said journal for contacting said force relieving surfaces, said ramming unit including third and fourth relieving surfaces complementing said first and second force relieving surfaces, said ramming unit during horizontal motion forcing said tongue into contact with a shell at a point along said shell engaging surface at the vertex of an acute angle formed by a vertical surface of said shell and said shell engaging surface whereby the ramming force is transferred to said shell with a minimum load on said journal.

9. The tongue mechanism of claim 8 wherein said tongue includes a bag charge receiving portion to move a bag charge to a position behind said shell.

* * * * *